United States Patent [19]

Sibler

[11] 4,402,208

[45] Sep. 6, 1983

[54] INDIRECT EXTRUSION PRESS WITH DIE CHANGER

[75] Inventor: Guenter W. Sibler, Pittsburgh, Pa.

[73] Assignee: Sutton Enigneering Company, Pittsburgh, Pa.

[21] Appl. No.: 253,778

[22] Filed: Apr. 13, 1981

[51] Int. Cl.[3] ..... B21C 23/02

[52] U.S. Cl. ..... 72/263; 72/273.5

[58] Field of Search ..... 72/255, 263, 273.5

[56] References Cited

U.S. PATENT DOCUMENTS

| | | | |
|---|---|---|---|
| 3,530,702 | 9/1970 | De Ridder | 72/273.5 |
| 3,563,079 | 2/1971 | Monie et al. | 72/255 |
| 3,844,151 | 10/1974 | Huertgen | 72/263 |
| 4,020,668 | 5/1977 | Doudet | 72/263 |
| 4,103,529 | 8/1978 | Huertgen et al. | 72/263 |

FOREIGN PATENT DOCUMENTS

| | | | |
|---|---|---|---|
| 2843178 | 4/1979 | Fed. Rep. of Germany | 72/273.5 |

*Primary Examiner*—Lowell A. Larson

*Attorney, Agent, or Firm*—Carothers & Carothers

[57] ABSTRACT

In an indirect extrusion press provided with a gate lock and a rearwardly extending indirect-extrusion stem, the stem normally extends through a die slide with the rear end of the stem engaged by a loose die disposed in the front end of a billet container behind the stem. After a ram has extruded a billet through the die and the gate lock has been released, the stem is moved forward clear of the die slide as the die is pushed into the slide, which is then moved transversely of the extrusion stem and out to the side of the gate lock housing for cleaning or replacement of the die.

3 Claims, 7 Drawing Figures

INDIRECT EXTRUSION PRESS WITH DIE CHANGER

Most indirect extrusion presses operate with a die attached to the free end of the indirect stem, or with a loose die dropped into a horseshoe-like receiver attached to the free end of the stem. In both cases, to make it easy to change the die the stem is shifted laterally to a position out beyond one side of the press frame. The die then is removed from the stem, changed, and the stem with a new die attached to it is moved back into operating position. This manner of changing dies is shown in U.S. Pat. No. 4,103,529, wherein the indirect stem and the die connected to it are moved laterally together. The stem cannot be retracted far enough for the die to be moved laterally away from it even if the two were not connected to each other. With certain aluminum alloys the indirect stem is moved out of the side of the press in order to be able to clean the build-up of aluminum behind the rim of the die attached to the stem. This cleaning of the die may be required after every second, third or fourth extrusion.

On the other hand, the ideal die for use in indirect extruding is one that is fully loose so that it can be handled like a dummy block. A fully loose die is one that is not attached to the indirect stem directly or indirectly. It has the advantage of possessing a greater diameter for a larger single extrusion, or for simultaneous multiple extrusions. In addition, during extrusion such a fully loose die will move without strain through the billet container and will not exert side forces on the stem due to inaccurate alignment. Although it is known that in one indirect extrusion press a fully loose die is exchanged by an arm that moves into and out of the press, the arm and its operating mechanism add cost and require additional maintenance.

It is among the objects of this invention to provide an indirect extrusion press, in which a fully loose die can be moved out to the side of the press frame independently of the indirect stem, and with which a new die can be placed in position for quick exchange while extruding is taking place through the other die.

The preferred embodiment of the invention is illustrated in the accompanying drawings, in which it is shown somewhat schematically.

Figure 1:
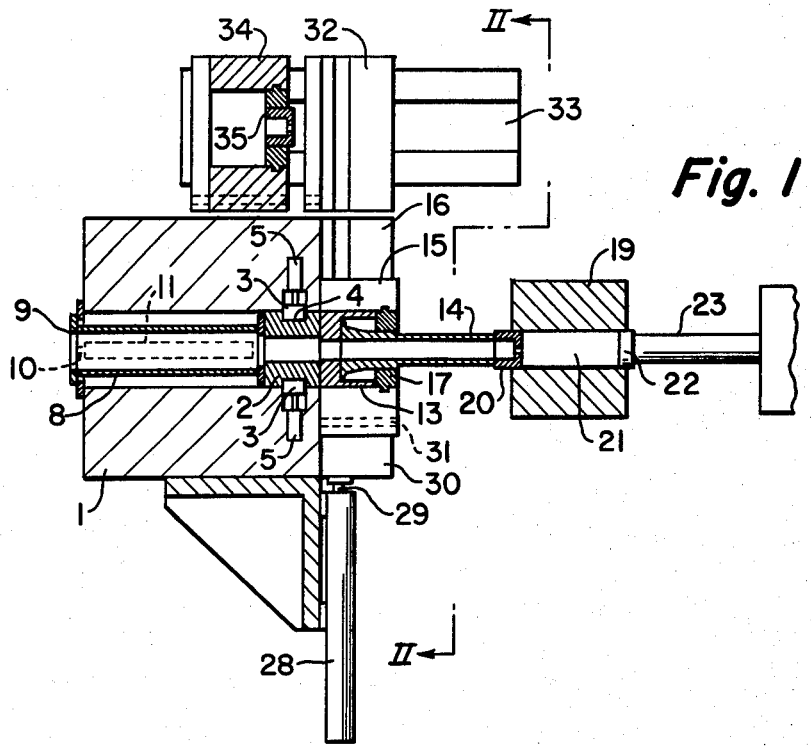
FIG. 1 is a horizontal section showing extrusion about to begin.
Figure 2:
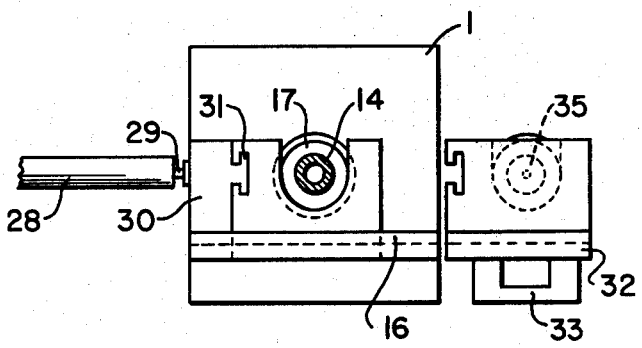
FIG. 2 is a vertical cross section taken on the line II—II of FIG. 1.

Referring to FIGS. 1 and 2 of the drawings, a gate lock housing 1 mounted in fixed position has a horizontal passage extending through it from front to back. Disposed in the rear end of this passage is a tubular block 2 that is held in place by a releasable gate lock. The gate lock can be formed from a pair of locking members 3 that are slidable horizontally toward and away from each other in guide ways formed in the housing. The inner ends of the locking members project into a peripheral recess 4 in the block. When the locking members are in locking position, the block cannot be moved axially. The locking members may be moved into and out of locking position by fluid pressure cylinders 5 rigidly mounted in the housing and supplied with hydraulic fluid in the customary manner.

Secured to the front end of the tubular block is a channel member 8 that extends forward out of the housing passage. Fastened to the front end of the channel is a vertical member 9 that extends down to the front end of a piston rod 10 extending back into a fluid pressure cylinder 11 rigidly mounted below the housing. When the gate lock is released, the piston rod can move block 2 forward and back in the housing passage.

Secured to the rear end of block 2 is a bolster 13 that has a central passage through it aligned with the opening through the block. Rigidly mounted in this bolster is the enlarged front end of a tubular indirect-extrusion stem 14. The bolster normally is housed in an opening through a die slide 15, from which the bolster can be withdrawn when the gate lock is released. The die slide, which is open at its top, engages the front of the gate lock housing and is slidable transversely thereof on a horizontal track 16 secured to the front of the housing. Mounted in the rear end of the die slide is a die holder 17 that encircles the stem and which can be lifted out of the slide when desired.

Figure 3:
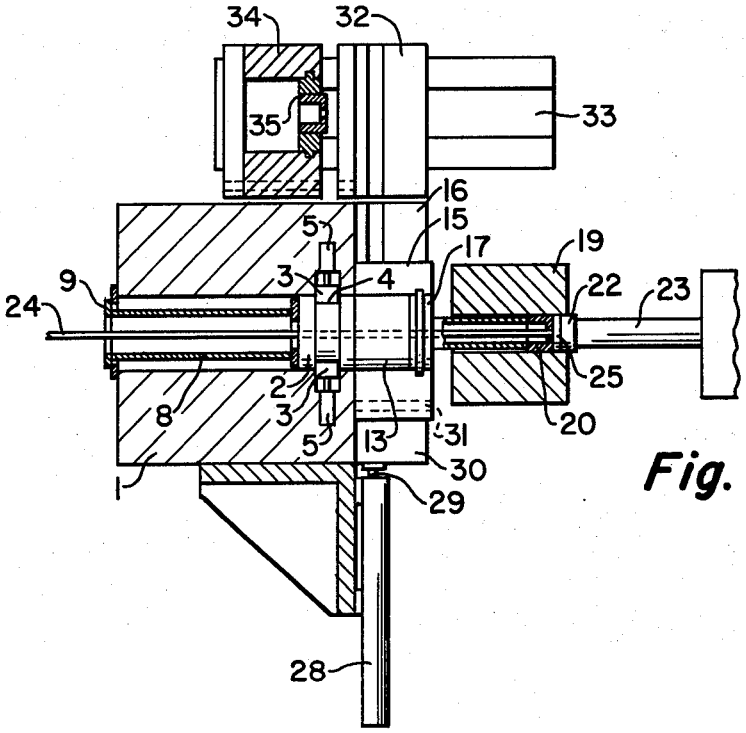
FIGS. 3, 4 and 5 are views similar to FIG. 1, showing the press in succeeding steps of the extrusion operation.

Behind the exposed or rear end of stem 14 there is a billet container 19, in the front end of which there is an extrusion die 20. Although the die engages the rear end of the stem, it is a fully loose die because it is not connected to the stem. In the container, directly behind the die, there is a heated billet 21, the rear end of which is engaged by a dummy block 22. The container can be moved toward and away from the die slide in a well known manner. Behind the container there are ram means that include a solid stem 23 that can be moved forward against the dummy block and then through the container when the ram means are actuated in the conventional way. While this stem is extruding the billet through the die to produce an extrusion 24 that passes forward through the indirect-extrusion stem and the tubular means formed by the bolster and block and out of the front end of the gate lock housing, the container moves forward around the stem as shown in FIG. 3. At the conclusion of extrusion, the die, dummy block and extrusion butt 25 are in the rear end of the container passage.

Figure 4:
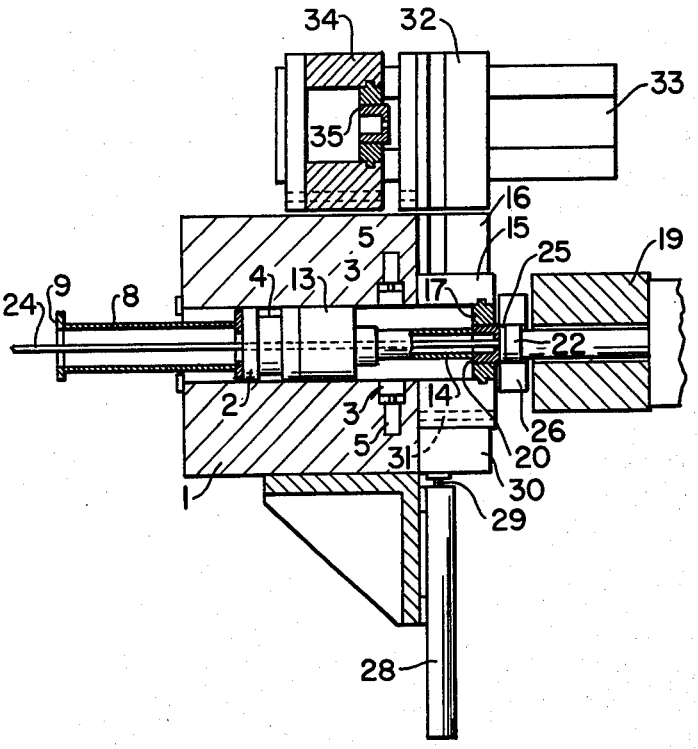

As shown in FIG. 4, the gate lock then is opened and indirect stem 14 is pulled forward until the butt, which has been pushed out of the container by stem 23, is directly behind the die holder 17 in position to be cut off by a shear (not shown). Moving the dummy block and butt forward caused the die to be pushed into the die holder. The dummy block is received by a supporting member 26 that has been raised to support both it and the severed butt, which are then lowered. The passage of the dummy block through the container cleans out the container passage.

Figure 5:
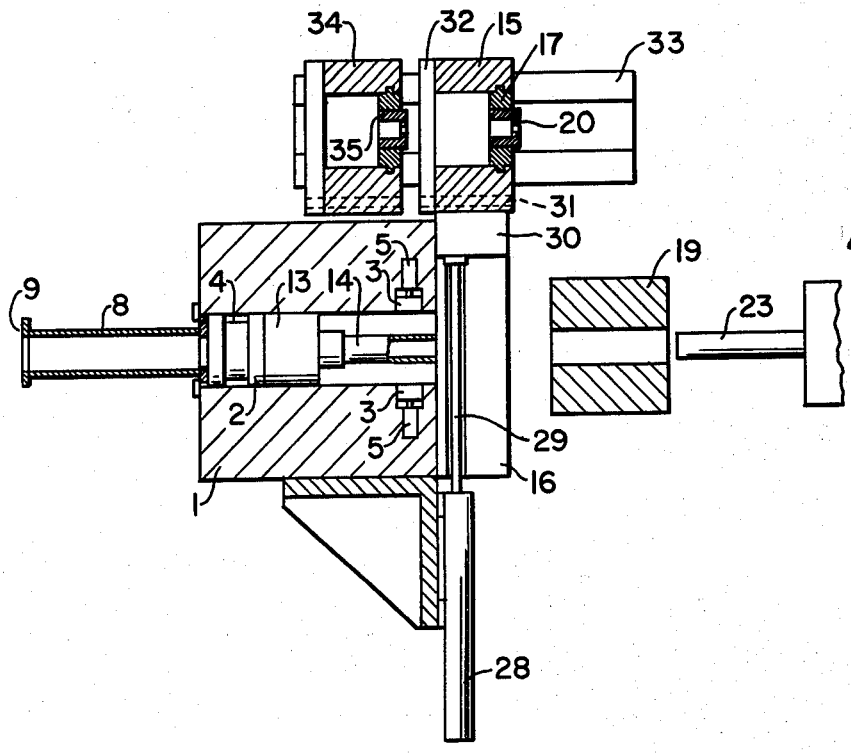
Figure 6:
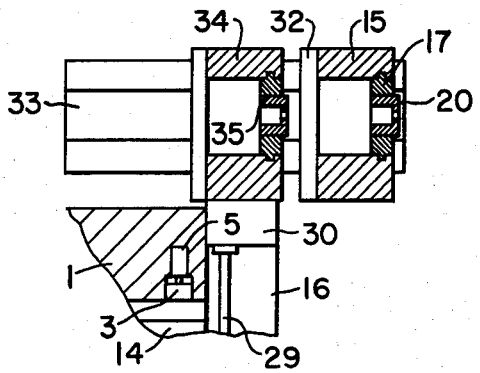
FIG. 6 is a fragmentary horizontal section showing the replacement die slide moved into position for travel into the press.
Figure 7:
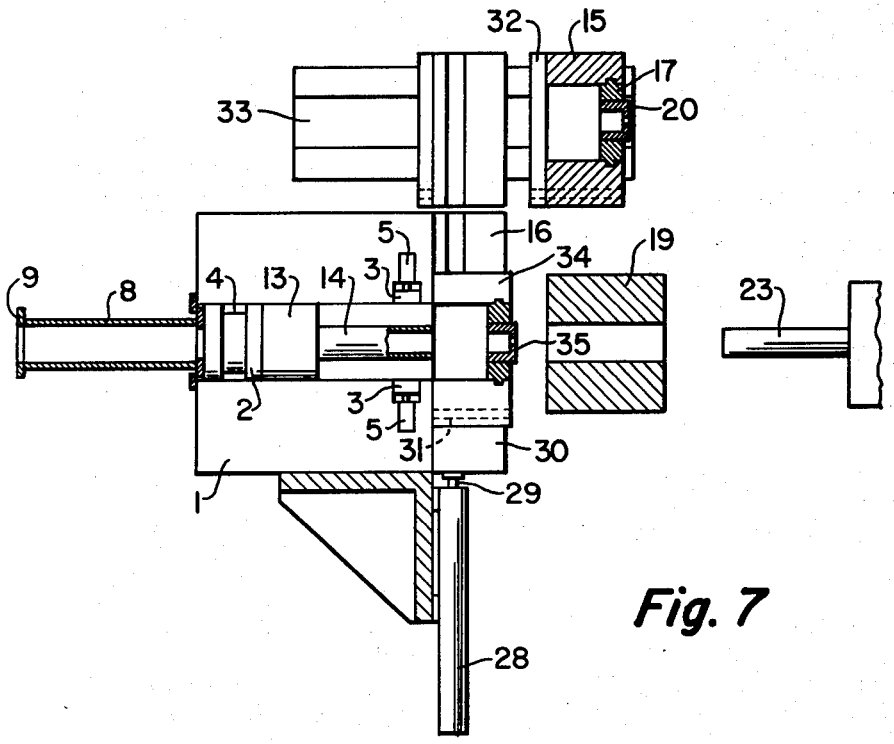
FIG. 7 is a view similar to FIG. 1, but showing the replacement die in operating position.

The next step is to move the indirect stem farther forward in the gate lock housing, away from the die and die slide, until the rear end of the stem is entirely within the rear end of the housing passage. The die slide 15 then is free to be moved along track 16 transversely of the gte lock housing to a point beyond one side of the housing as shown in FIG. 5. This movement of the slide can be accomplished by any suitable means, but preferably by means of a fluid pressure cylinder 28 projecting from one side of the gate lock housing, to which it is secured at one end of the track. A piston rod 29 projects from the cylinder and is detachably connected to the adjacent side of the slide, preferably through the medium of a connecting member 30 attached to the piston rod and movable along the track. As shown in FIG. 2, this member is provided with a T-shape rib 31 that fits in a T-shape slot in the adjoining side of the die slide. The slot extends front to back of the die slide. When the piston rod is extended, the connecting member 30 pushes the slide and die out to one side of the housing and onto a receiving table 32. The die slide then can be disconnected from the connecting member by moving the table rearwardly on its track 33. At the same time, as shown in FIG. 6, a similar die slide 34 containing a die holder and a die 35 can be moved by the table into engagement with connecting member 30 and then pulled back by the piston rod to operative position between the gate lock housing passage and the billet container as shown in FIG. 7. This is a quick and simple way to change dies. If it is not desired to change the dies but merely to clean a die, the die can be removed from die holder 17 and die slide 15 on table 32, cleaned and then replaced.

With the extrusion press described herein, the fluid pressure cylinders can be programmed by an electrical system to operate at predetermined intervals in the proper sequence so that changing of the die is performed automatically at regular intervals.The control system is not part of this invention and is not claimed herein, but the construction of the press lends itself to such automatic operation.

According to the provisions of the patent statutues, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In an indirect extrusion press, a gate lock housing having a rear face and an extrusion-receiving horizontal passage extending through it from front to back, a die slide behind said housing provided with a die-receiving passage therethrough aligned with said housing passage, a billet container behind said die slide movable toward and away from it, ram means behind the container movable toward and away from it, tubular means slidably disposed in said housing passage, releasable gate lock means in said housing normally holding said tubular means in place, an indirect-extrusion stem secured to said tubular means in alignment therewith and extending rearwardly through the die slide toward said container, a fully loose die disposed in the front end of said container and abutting against the rear end of said stem, said ram means including means for engaging the rear end of a billet in the container for extruding the billet through the die, means operable after extrusion and release of said gate lock means for moving said tubular means and stem forward together to move the stem clear of the slide as said ram means pushes the die into said slide passage, and sliding means for then moving the die slide with the die therein tranversely of the indirect-extrusion stem and out to the side of the housing for cleaning or replacing the die.

2. In an indirect extrusion press according to claim 1, a second die slide, a die in said second slide, each slide being formed for detachable connection to said sliding means in the absence of the other, and means at the side of said housing for receiving and supporting said die slides with the dies therein.

3. In an indirect extrusion press according to claim 2, a table beside said housing for supporting said die slides one behind the other and being movable parallel to said passages to disconnect the first die slide from said sliding means and connect the second die slide to the sliding means.

* * * * *